United States Patent [19]

Gabler et al.

[11] Patent Number: 4,588,418

[45] Date of Patent: May 13, 1986

[54] RECYCLE OF RECLAIMED WATER IN PARTIAL OXIDATION PROCESS

[75] Inventors: William A. Gabler, Seabrook, Tex.; Frank M. Julian, Wilmington, Del.

[73] Assignee: E. I. Du Pont de Nemours and Company, Wilmington, Del.

[21] Appl. No.: 464,617

[22] Filed: Feb. 7, 1983

[51] Int. Cl.[4] ..... C10J 3/46

[52] U.S. Cl. ..... 48/197 R; 48/206; 252/373

[58] Field of Search ..... 48/197 R, 206, 212, 48/215, DIG. 7; 210/634; 252/373

[56] References Cited

U.S. PATENT DOCUMENTS 4,141,695 2/1979 Marion et al. ..... 48/197 R 4,205,963 6/1980 Marion et al. ..... 252/373

*Primary Examiner*—Peter Kratz

[57] ABSTRACT

In a partial oxidation process the gaseous effluent from a reactor is contacted with water to cool and remove solid particulates, i.e., ash and soot. The water from this operation is then mixed with an organic extractant, e.g., naphtha, and fed into a decanter to form aqueous and organic phases. The aqueous phase from the decanter is fed to a water flash separator to remove dissolved gases. The solids in a portion of the water flash separator bottoms are further concentrated in a hydrocyclone and thereafter purged. The remaining water is recycled for recontact with the gaseous effluent.

1 Claim, 1 Drawing Figure

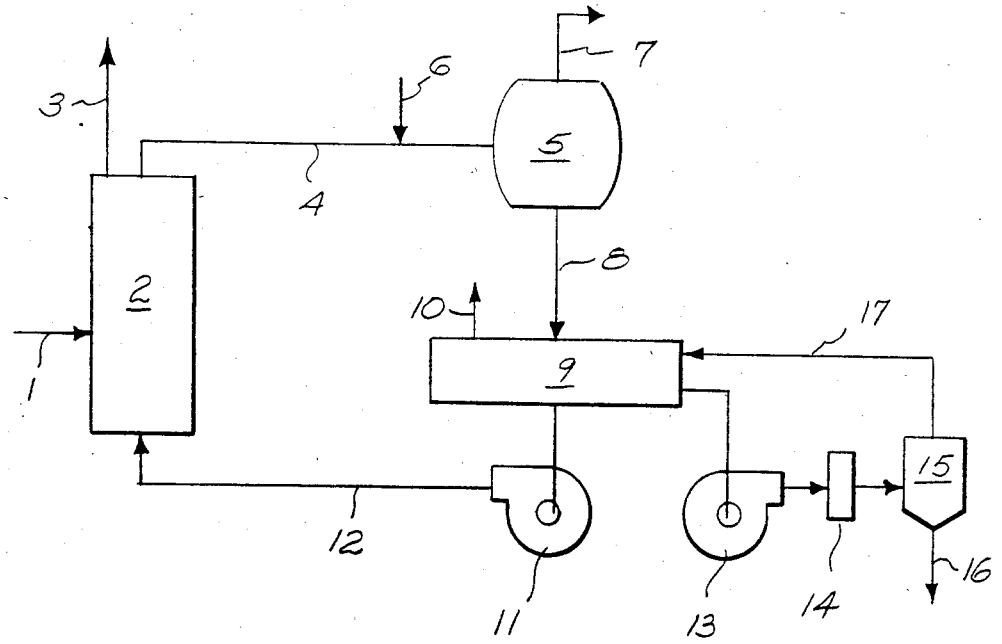
1
2
3
4
5
6
7
8
9
10
11
12
13
14
15
16
17

RECYCLE OF RECLAIMED WATER IN PARTIAL OXIDATION PROCESS

BACKGROUND OF THE INVENTION

Processes have been developed for the partial oxidation of various liquid, solid and gaseous hydrocarbonaceous feeds, e.g., methane, residual oil, coal, etc., with an oxygen-containing gas to produce synthesis gas, i.e., a gas containing primarily hydrogen and carbon monoxide. The product synthesis gas contains significant amounts of free carbon in the form of soot, particularly when heavy hydrocarbons are employed as feedstock. Various processes have been developed for the separation and recovery of this soot. One method involves scrubbing or quenching the product gas with water to produce a water-soot slurry. The slurry is then treated with a liquid organic extractant, e.g., naphtha, to produce a phase separation, i.e., water and naphtha-soot phases. The naphtha-soot phase is then treated to separate and recover the naphtha and soot. Descriptions of such processes can be found in U.S. Pat. Nos. 2,992,906; 3,473,903; 3,694,355 and 3,917,569.

In these processes the phase separation usually takes place in a decanter. The aqueous phase from the decanter, which contains dissolved gases, naphtha and suspended solids is fed into a flash column wherein the dissolved gases are flashed off overhead and, for reasons of economy, the water recovered for recycle to the scrubbing or quenching step.

U.S. Pat. No. 4,141,695 discloses the use of a flash column for water recovery in such a process. This column not only removes the dissolved gases, but concentrates the suspended solids in a portion of the water which portion is then purged.

SUMMARY OF THE INVENTION

The prior art processes, particularly the process of U.S. Pat. No. 4,141,695, have been improved by concentrating the suspended solids from a water flash separator bottoms using a hydrocyclone.

The water flash separator bottoms are conventionally recycled to the gas scrubbing or quenching step in the partial oxidation process. Thus any suspended solids contained therein, e.g., ash particles, are brought into contact with synthesis gas. This increases the likelihood they will be carried out with gas stream and create problems in the further processing of the gas.

For example, any nickel or iron present in the ash can form gaseous carbonyl compounds which could decompose on the surfaces of downstream equipment and cause fouling. The nickel can also create problems by forming low-melting eutectics on metal surfaces, e.g., of waste heat boiler tubes, thereby fluxing away the protective surface and cause corrosion. Any calcium and vanadium present can form carbonates and phosphates and foul exchangers. Furthermore, if a purge is used to keep the ash concentration of the recycle water at a reasonable level, in view of the usual concentration of 400–1500 ppm ash, a large purge of low ash content must be employed. This high volume purge requires a waste treatment facility of large capacity to handle it before it can be discharged.

The use of the hydrocyclone enables the ash particles to be concentrated in a purge stream of significantly smaller volume, thus removing most of the metals which could cause problems without overloading or requiring a large capacity waste water treatment facility. Or if desired, a large purge could be continued and thereby reducing the solid-concentration level in the recycled water.

DESCRIPTION OF THE DRAWING

The FIGURE is a flow diagram of an embodiment of the process of the invention.

DETAILED DESCRIPTION OF THE INVENTION

Referring to the FIGURE, the effluent 1 from a partial oxidation reactor is fed to a water quench drum or a water scrubber, or both 2. The reactor (not illustrated) can be any used in the art and its feedstocks are not critical, i.e., can be liquid, solid or gaseous hydrocarbon and air or oxygen. The effluent from the reactor is a gaseous mixture containing mainly hydrogen, carbon monoxide, water and soot (unoxidized carbon particles). It also can contain other gases such as $H_2$, $CO_2$, $H_2S$, COS, $CH_4$, CO, $NH_3$ and nitrogen, their presence and amount thereof depending on the hydrocarbonaceous feed and oxygen-containing gas used as feedstock for the reactor. The effluent will also contain, generally more then 400 ppm, depending upon the hydrocarbonaceous feed used, amounts from 100–700 ppm of small particles, average particle size less than one micrometer and typically about 0.5 micrometer. Particle size is measured using settling rates as is well known in the art. These small ash particles will contain the following materials: vanadium, sulfur, nickel, iron, calcium, sodium and molybdenum or their reaction products, e.g., their sulfides.

Within the scrubber or quench 2 the hot effluent is cooled by direct contact with water. The water also removes the solid particles in the effluent, i.e., the soot and ash. Typically the water will contain 1500 ppm ash particles. The clean gas exits the quench or scrubber 2 as overhead 3 and is thereafter purified or subjected to further treatment depending upon its intended end use. The scrubber or quench is operated under conditions well known to those in the art, e.g., as set forth in U.S. Pat. No. 4,141,695.

The water from the scrubber is fed through a line 4 to a decanter 5. Prior to entering the decanter an organic extractant 6 is added to the water in one or two stages. The process can employ as extractant various light hydrocarbon liquids, such as naphtha, gasoline, benzol, heptanes, oxygenated hydrocarbons, and the like; however, since naphtha is the preferred liquid for use, the following description will be directed to that preferred embodiment.

In the decanter two phases are formed, a naphtha-soot rich phase and an aqueous phase. The decanter is designed and operated as is well known in the art, e.g., as described in U.S. Pat. Nos. 4,014,786 or 4,141,695. It is preferred to operate the decanter such that most of the ash particles are in the aqueous phase, i.e., 80–85% in aqueous and 15–20% in naphtha-soot phase. However, the process is operable when less amounts of ash are in the aqueous phase, i.e., as low as 40%.

The naphtha-soot rich phase is removed from the top of the decanter for further treatment to recover the naphtha and soot, e.g., as described in U.S. Pat. Nos. 4,141,695 or 4,211,638. A portion of the ash particles is removed with the naphtha-soot phase, but most of it remains with the aqueous phase.

A stream 8 of water containing dissolved gases, e.g., $CO_2$, $H_2S$, COS, $CH_4$, $NH_3$, H, CO and $N_2$, and ash particles (gray water) is removed from the bottom of the decanter and fed to a water flash separator 9 for reclamation.

The water flash separator is operated under such conditions to flash off as overhead 10 the gases dissolved in the gray water, e.g., $H_2S$, $CO_2$, $NH_3$, $CH_4$, etc. Any water that is also flashed off is condensed (not illustrated) and returned to the decanter. The remaining water containing the solid particulates is collected at the bottom of the separator and a portion is pumped 11 from the column 9 and recycled to the quench or scrubber 2 through line 12.

Any water flash separator can be used. The design and operation of one type water flash is disclosed in U.S. Pat. No. 4,141,695. In this column stripping or concentration of solids is conducted, although this is not necessary for the process of the invention.

In the conventional process another portion of the gray water is purged from process. In most embodiments this will require purging a large volume of water containing a small amount of solids.

In the process of the invention the gray water is pumped 13 from the bottom of the water flash separator and, optionally, fed through a strainer 14 to remove large size particulates over 0.05 inch (1.27 mm) in size to avoid downstream pluggage. Other means can be used to remove these particles, e.g., filters, settling chambers, liquid cyclone, and the like. The gray water is then fed into a hydrocyclone (or liquid cyclone) 15 where the solids are concentrated in a portion of the water which is purged through line 16. In a typical operation, with a 15% bottoms flow, there will be a 3.5 times concentration of the ash in this flow. The remaining gray water, with lower solids concentration, is returned to the water flash separator through line 17 for recycle.

In view of the particle size of the ash particles, the hydrocyclone employed should have a maximum diameter of 10 mm.

In an embodiment of the invention at equilibrium, the feed to the hydrocyclone can be at the rate of 100 $m^3/h$ and contain 450 ppm solids. A series of hydrocyclones of 10 mm diameter treats this feed (17 model TMl Dorr-clones manufactured by Dorr-Oliver Co.). The overhead, recycle 17 can be at the rate of 85 $m^3/h$ and the solids concentration 250 ppm while the purge 16 is at the rate of 15 $m^3/h$ and has a solids concentration of 1550 ppm.

We claim:

1. In a partial oxidation process for producing gaseous mixtures containing $H_2$, CO, water, soot, gaseous materials including one or more of $CO_2$, $H_2S$, COS, $CH_4$, $NH_3$ and $N_2$ and between 100 and 700 ppm ash particles comprising materials including vanadium, sulfur, nickel, iron, calcium, sodium, molybdenum, or their reaction products, the particles having an average particle size less than one micrometer, by the partial oxidation of a hydrocarbonaceous feed with an oxygen-containing gas; contacting the gaseous mixture with water in a gas quenching or scrubbing step or both; removing a water stream from this step containing soot; dissolved gaseous materials and suspended ash particles; adding a liquid organic extractant to the stream; feeding the stream to a decanter wherein aqueous and organic phase form; removing from the bottom of the decanter the aqueous phase containing water, dissolved gaseous material, soot and the suspended ash particles; feeding the dissolved aqueous phase to water flash separator wherein the dissolved gases are flashed off; and removing from the bottom of the water flash separator the remaining liquid phase for recycle to the quenching or scrubbing step and purging part of this liquid phase; the improvement comprising concentrating the suspended ash particles in the purge stream using a hydrocyclone having a maximum diameter of 10 mm.

* * * * *